US010394144B2

(12) United States Patent
Sakimura et al.

(10) Patent No.: US 10,394,144 B2
(45) **Date of Patent: *Aug. 27, 2019**

(54) ELECTROPHOTOGRAPHIC PHOTOSENSITIVE BODY AND IMAGE FORMING APPARATUS

(71) Applicant: Konica Minolta, Inc., Tokyo (JP)

(72) Inventors: Tomoko Sakimura, Hino (JP); Toyoko Shibata, Zama (JP); Masanori Yumita, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/891,955

(22) Filed: Feb. 8, 2018

(65) Prior Publication Data

US 2018/0239268 A1 Aug. 23, 2018

(30) Foreign Application Priority Data

Feb. 17, 2017 (JP) ..... 2017-027870

(51) Int. Cl.

| | |
|---|---|
| ***G03G 5/147*** | (2006.01) |
| ***G03G 5/14*** | (2006.01) |
| ***G03G 5/05*** | (2006.01) |
| ***G03G 5/06*** | (2006.01) |

(52) U.S. Cl.

CPC ..... *G03G 5/1476* (2013.01); *G03G 5/144* (2013.01); *G03G 5/14704* (2013.01); *G03G 5/0542* (2013.01); *G03G 5/0564* (2013.01); *G03G 5/0614* (2013.01); *G03G 5/0696* (2013.01); *G03G 2215/00957* (2013.01)

(58) Field of Classification Search

CPC ..... G03G 5/147; G03G 5/14726; G03G 5/14708; G03G 5/14704

See application file for complete search history.

(56) References Cited

U.S. PATENT DOCUMENTS

| | | | | |
|---|---|---|---|---|
| 5,834,564 | A * | 11/1998 | Nguyen | C08F 216/1416 525/326.3 |
| 9,964,871 | B2 * | 5/2018 | Sakimura | G03G 5/047 |
| 2013/0244150 | A1 * | 9/2013 | Toshine | G03G 5/14773 430/56 |
| 2014/0286682 | A1 * | 9/2014 | Sakamoto | G03G 15/162 399/302 |
| 2015/0323888 | A1 * | 11/2015 | Sakamoto | G03G 15/162 428/411.1 |

FOREIGN PATENT DOCUMENTS

| | | | |
|---|---|---|---|
| JP | 2012128324 | A | 7/2012 |
| JP | 2015028613 | A | 2/2015 |
| JP | 2015184489 | A | 10/2015 |
| JP | 2016126163 | A | 7/2016 |

OTHER PUBLICATIONS

Machine Englislh langauge translation of Publication No. JP 2015-184489, Oct. 22, 2015.*

* cited by examiner

*Primary Examiner* — Thorl Chea
(74) *Attorney, Agent, or Firm* — Lucas & Mercanti, LLP

(57) ABSTRACT

An electrophotographic photosensitive body includes at least a photosensitive layer and a protective layer sequentially laminated on an electroconductive support, wherein the protective layer has a domain containing perfluoropolyether.

11 Claims, 2 Drawing Sheets

ELECTROPHOTOGRAPHIC PHOTOSENSITIVE BODY AND IMAGE FORMING APPARATUS

The entire disclosure of Japanese patent Application No. 2017-027870, filed on Feb. 17, 2017, is incorporated herein by reference in its entirety.

BACKGROUND

Technological Field

The present invention relates to an electrophotographic photosensitive body and an image forming apparatus. More specifically, the present invention relates to an electrophotographic photosensitive body having high wearing resistance, having sustained high cleaning property, and providing suppressed image blur under a high-temperature and high-humidity environment, and an image forming apparatus including this electrophotographic photosensitive body.

Description of the Related Art

In recent years, toners having small particle sizes are mainly used due to increase in demand for high-definition and high-quality images. A toner having a small particle size has a large adhesion force a surface of an image carrier such as an electrophotographic photosensitive body (hereinafter also simply referred to as a photosensitive body) or an intermediate transfer body, and thus removal of a residual toner such as a transfer residual toner attached to the surface tends to be insufficient. In a cleaning system using a rubber blade, slip-through of the toner easily occurs, and in order to solve such slip-through, it is necessary to increase the abutting pressure of the blade against the image carrier. However, a problem that the surface of the image carrier is worn and the durability becomes insufficient by repetitive use occurs.

As a means for decreasing an adhesion force between a surface of an image carrier and a toner to increase cleaning property, addition of a fluorine-based material such as fluorine-based microparticles or a fluorine-based lubricant to a surface layer of an image carrier is suggested. However, said fluorine-based material tends to cause deterioration in mechanical properties such as wearing resistance in the image carrier. Furthermore, the fluorine-based material tends to present at a high concentration in the vicinity of the surface of the image carrier due to its high surface alignment. Therefore, although said image carrier has high cleaning property at the initial stage of use thereof, when the surface is worn due to repetitive use, the high cleaning property of the image carrier tends to be insufficient.

As a technique for improving both the wearing resistance and the sustention of the high cleaning property of a photosensitive body, for example, a radical-polymerizable cured surface layer containing a perfluoropolyether (PFPE) is known (see JP 2012-128324 A, JP 2015-028613 A, JP 2015-184489 A and JP 2016-126163 A).

However, in a photosensitive body having such surface layer, attainment of a balance between wearing resistance and sustention of high cleaning property is still insufficient.

Furthermore, there is also a problem that PFPE is chemically deteriorated by discharging products that generate during charging such as ozone and nitrogen oxides, and thus image blur easily occurs under a high-temperature and high-humidity environment.

SUMMARY

The present invention has been made in view of the above-mentioned problems and circumstances, and an object of the present invention is to provide an electrophotographic photosensitive body having high wearing resistance, having sustained high cleaning property, and providing suppressed image blur under a high-temperature and high-humidity environment, and an image forming apparatus including this electrophotographic photosensitive body.

To achieve the abovementioned object, according to an aspect of the present invention, an electrophotographic photosensitive body reflecting one aspect of the present invention comprises at least a photosensitive layer and a protective layer sequentially laminated on an electroconductive support, wherein the protective layer has a domain containing perfluoropolyether.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
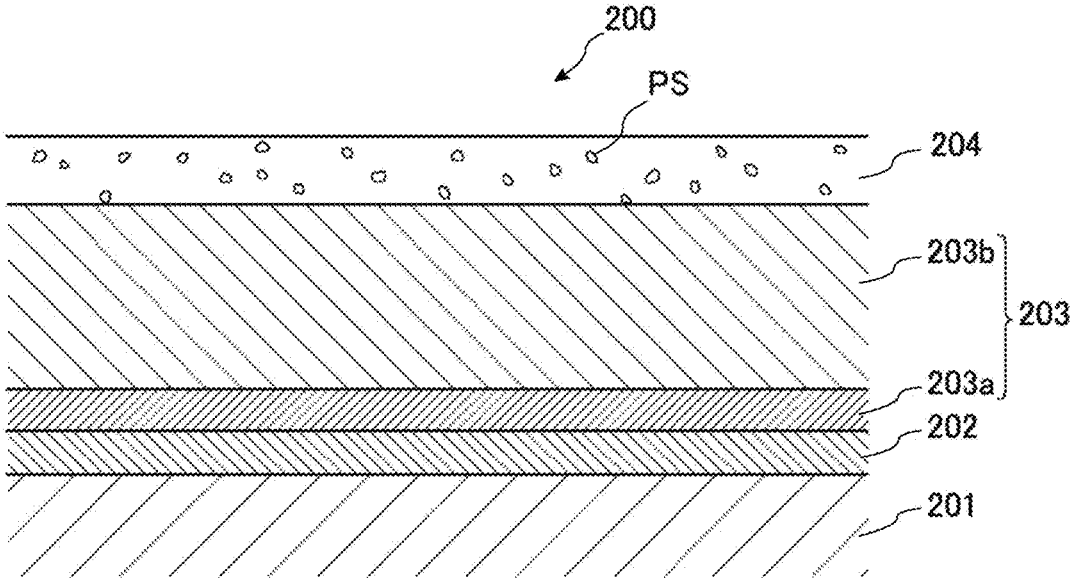
FIG. 1 is a cross-sectional view showing an example of a layer constitution of an electrophotographic photosensitive body according to an embodiment of the present invention.

Hereinafter, one or more embodiments of the present invention will be described with reference to the drawings. However, the scope of the invention is not limited to the disclosed embodiments.

The electrophotographic photosensitive body of the present invention includes a protective layer having a perfluoropolyether-containing domain. This feature is common in the inventions as claimed in the respective claims.

According to an embodiment of the present invention, it is preferable that the domain has an average long diameter in the range of 0.05 to 1.00 μm from the viewpoint that the effect of the present invention is further expressed.

Furthermore, it is preferable that the protective layer is formed of a polymerization cured product of a radical-polymerizable composition containing a radical-polymerizable monomer and a perfluoropolyether having radical-polymerizable group(s). Accordingly, the transfer of the PFPE to the outermost surface can be suppressed, whereby the PFPE can be present throughout the protective layer.

Furthermore, it is preferable that the radical-polymerizable composition further contains metal oxide particles from the viewpoints of improvement of the strength of the protective layer and further improvement of the wearing resistance.

Furthermore, it is preferable that the content of the metal oxide particles in the radical-polymerizable composition is in the range of 45 to 150 parts by mass with respect to the total amount (100 parts by mass) of the radical-polymerizable monomer and the perfluoropolyether having radical-polymerizable group(s). Accordingly, the mechanical strength of the protective layer can be sufficiently expressed, suitable electrical resistance can be attained, and cleaning property can be sufficiently expressed.

Furthermore, it is preferable that the metal oxide particles are metal oxide particles having a radical-polymerizable group. Since the metal oxide particles form chemical bonds with the radical-polymerizable composition, the strength of the protective layer can be improved, and the wearing resistance can further be improved.

Furthermore, it is preferable that the perfluoropolyether having radical-polymerizable group(s) is a perfluoropolyether having a structure represented by General Formula (1). By having radical-polymerizable group at the both terminals of the perfluoropolyether chain, a highly-cross-linked structure can be formed, and thus the wearing resistance of the protective layer can further be improved.

Furthermore, it is preferable that the radical-polymerizable group represented by X of General Formula (1) is an organic group having a structure represented by General Formula (2), since the radical-polymerizable group represented by X of General Formula (1) can be reacted with the radical-polymerizable monomer at a small amount of light or in a short time.

The present invention can provide an image forming apparatus including the above-mentioned electrophotographic photosensitive body.

The present invention and the constitutional elements thereof, and the forms and embodiments for carrying out the present invention will be explained below in detail. In the present application, "to" for representing a numerical range is used to mean that the numerical values described before and after said word are encompassed as a lower limit value and an upper limit value.

<<Electrophotographic Photosensitive Body>>

The electrophotographic photosensitive body of the present invention includes at least a photosensitive layer and a protective layer sequentially laminated on an electroconductive support, wherein the protective layer contains a perfluoropolyether-containing domain.

The photosensitive layer in the present invention has both a function to absorb light to generate electrical charge and a function to transport electrical charge. The layer constitution of the photosensitive layer may be either a single layer structure including a charge generating substance and a charge transporting substance, or may be a laminate structure of a charge generating layer including a charge generating substance and a charge transporting layer including a charge transporting substance.

Furthermore, the electrophotographic photosensitive body of the present invention may have an intermediate layer disposed between the electroconductive support and the photosensitive layer as necessary.

Examples of the specific layer constitution of the electrophotographic photosensitive body include those indicated below.

(1) A layer constitution in which a photosensitive layer consisting of a charge generating layer and a charge transporting layer, and a protective layer, are sequentially laminated on an electroconductive support.

(2) A layer constitution in which a single photosensitive layer containing a charge transporting substance and a charge generating substance, and a protective layer are sequentially laminated on an electroconductive support.

(3) A layer constitution in which an intermediate layer, a photosensitive layer consisting of a charge generating layer and a charge transporting layer, and a protective layer are sequentially laminated on an electroconductive support.

(4) A layer constitution in which an intermediate layer, a single photosensitive layer containing a charge transporting substance and a charge generating substance, and a protective layer are sequentially laminated on an electroconductive support.

The electrophotographic photosensitive body of the present invention may be any of the above-mentioned layer constitutions of (1) to (4), and among these, the electrophotographic photosensitive body having the above-mentioned layer constitution of (3) is specifically preferable.

FIG. 1 is a cross-sectional view showing an embodiment of the layer constitution of the electrophotographic photosensitive body of the present invention.

As shown in FIG. 1, the electrophotographic photosensitive body 200 is constituted by sequentially laminating an intermediate layer 202, a photosensitive layer 203 and a protective layer 204 on an electroconductive support 201.

The photosensitive layer 203 is constituted by a charge generating layer 203*a* and a charge transporting layer 203*b*.

The protective layer 204 contains metal oxide particles PS.

The respective layers that constitute the electrophotographic photosensitive body of the present invention will be explained below in detail.

<Protective Layer>

The protective layer in the present invention has a domain containing a perfluoropolyether (PFPE).

The PFPE refers to an oligomer or a polymer having a perfluoroalkylene ether as a repeating unit. Examples of the repeating unit of the perfluoroalkylene ether include repeating unit of perfluoromethylene ether, perfluoroethylene ether and perfluoropropylene ether.

In a case where the PFPE has a plurality of structural units, the structural units may form a block copolymer structure or may form a random copolymer structure.

The number average molecular weight (Mn) of the PFPE is preferably in the range of 300 to 8,000, more preferably in the range of 500 to 5,000. If the molecular weight is 300 or more, the effect of the PFPE to sustain high cleaning property can be sufficiently exerted. If the molecular weight is 8,000 or less, the compatibility of the binder resin and the PFPE is high, and thus phase separation in an application liquid for forming a protective layer, and occurrence of shedding during application can be suppressed.

The number average molecular weight (Mn) of the PFPE can be obtained by a known analysis method such as gel permeation chromatography (GPC).

(Method for Measuring PFPE Domain)

The presence or absence of the domain of the PFPE in the protective layer can be confirmed by enlarging a cross-sectional surface obtained by cutting the protective layer of the photosensitive body by a microtome in the thickness direction to 10,000-fold and observing the cross-sectional surface under a scanning electron microscope.

The domain containing the PFPE is phase-separated from the matrix containing the binder resin. However, even in a case where the phases are separated, the component compositions of the matrix and the domain are not always separated in a strict manner. Even in a matrix-domain structure having a clear interface between a matrix and a domain, each of the phases (matrix and domain) may contain the components of the other phase in minute amounts. For example, the PFPE domain may contain the components of the matrix at lower than 50% by mass.

In the measurement by a scanning electron microscope, the binder resin part and the PFPE domain are observed as a difference in contrasts.

Figure 2:
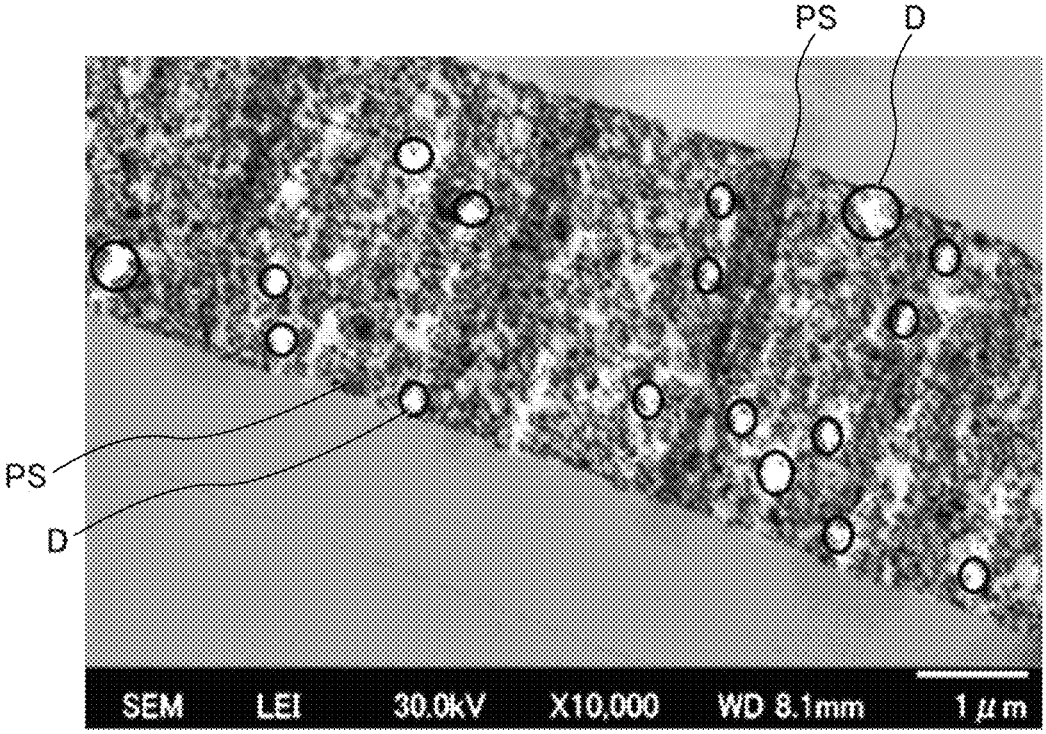
FIG. 2 is a scanning electron microscopic photograph showing an example of a cross-sectional surface when a protective layer in an embodiment of the present invention is cut in a thickness direction.

For example, in a scanning electron microscopic photograph of the cross-sectional surface of the protective layer in the thickness direction, metal oxide particles are observed in black (symbol PS in FIG. 2), and among the periphery regions thereof, the region specifically observed in white is the PFPE domain (the part surronded by a circle (symbol D) in FIG. 2).

That the domain includes PFPE can be identified by using an energy-dispersion type X-ray analyzer (EDX) or a TOF-SIMS. Specifically, fluorine atoms can be detected by conducting an elemental analysis by an EDX on the domain, and a fragment of a fluorocarbon ether structure derived from the PFPE can be observed by a TOF-SIMS from the domain.

(Average Long Diameter of PFPE Domain)

It is preferable that the domain containing the PFPE has an average long diameter in the range of 0.05 to 1.00 μm. If the average long diameter is smaller than 0.05 μm, the effect of the PFPE to suppress chemical deterioration is decreased, and thus suppression of image blur under a high-temperature and high-humidity environment and maintenance of high cleaning property tend to be insufficient. If the average long diameter is more than 1.00 μm, since the crosslinking density of the PFPE-flocculated part is low, and thus a region having weak film strength is locally generated and the wearing resistance tends to be insufficient.

The average long diameter of the PFPE domain is calculated as a number average diameter of 20 domains that are randomly selected in a scanning electron microscopic photograph of the cross-sectional surface in the thickness direction of the above-mentioned protective layer.

(Radical-Polymerizable PFPE)

It is preferable that the protective layer according to the present invention is formed by a polymerization-cured product of a radical-polymerizable composition containing a radical-polymerizable monomer (the details will be mentioned below) and a perfluoropolyether having radical-polymerizable group(s) (hereinafter also referred to as a radical-polymerizable PFPE).

The radical-polymerizable PFPE is preferably a PFPE having a structure represented by the following formula (1).

[Chemical Formula 3]

$$(X)_q\text{-}A\text{-}CF_2O(CF_2CF_2O)_m(CF_2O)_nCF_2\text{-}A\text{-}(X)_q \quad \text{General Formula (1)}$$

In General Formula (1), A represents a linking group having a valency of (q+1), X represents a radical-polymerizable group, m and n each represents an integer of 0 or more, provided that m+n≥5, and q represents an integer of 1 or more.

It is preferable that the linking group A is a linking group having a molecular weight in the range of 100 to 400. Since the molecular weight of the linking group A is 100 or more, the compatibility to the radical-polymerizable monomer is increased, and thus it becomes possible to add the PFPE in a sufficient amount. Furthermore, since the molecular weight of the linking group A is 400 or less, the wearing resistance of the protective layer is sufficiently increased. The molecular weight of the linking group A can be obtained by a known analysis method such as gel permeation chromatography (GPC), nucleic magnetic resonance (NMR) or the like.

Examples of the linking group A include linking groups having the following structures. In linking groups A1 to A16, *1 represents a binding site to the carbon atoms at the both terminals of —$CF_2O(CF_2CF_2O)_m(CF_2O)_nCF_2$—, and *2 represents a binding site to the radical-polymerizable group X.

| | [Chemical Formula 4] | Molecular weight |
|---|---|---|
| A1 | 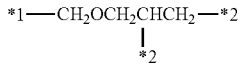 | 71.1 |
| A2 | 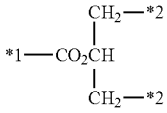 | 85.1 |
| A3 | 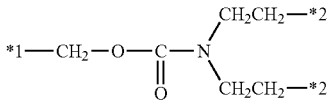 | 128.2 |
| A4 | 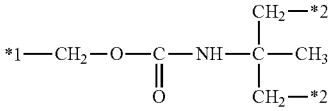 | 128.2 |
| A5 | 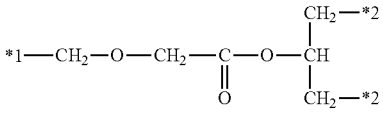 | 129.1 |

-continued
| | | Molecular weight |
|---|---|---|
| A6 | 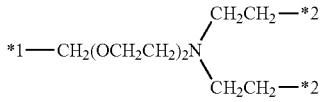 | 172.2 |
| A7 | 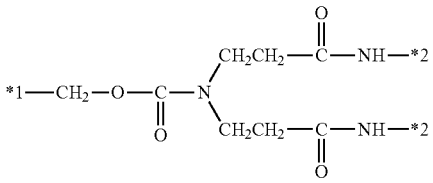 | 214.2 |
| A8 | 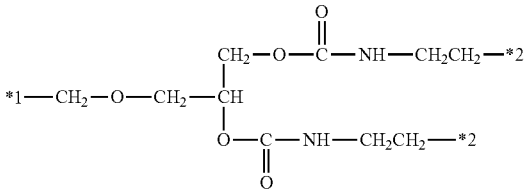 | 245.3 |
| A9 | 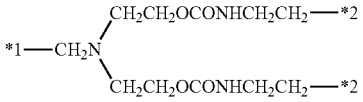 | 258.3 |
[Chemical Formula 5]
| | | |
|---|---|---|
| A10 | 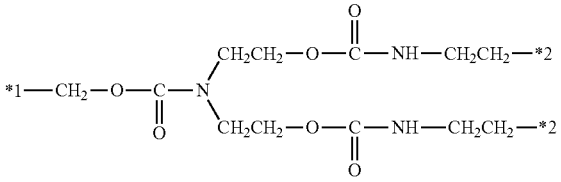 | 302.3 |
| A11 | 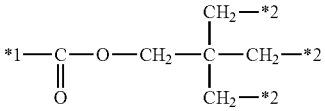 | 112.1 |
| A12 | 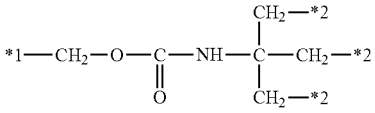 | 127.1 |
| A13 | 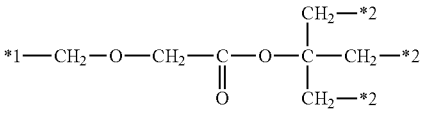 | 142.2 |
| A14 | 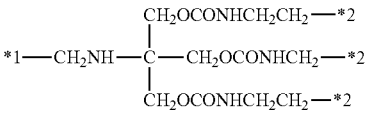 | 344.4 |

-continued

| | | Molecular weight |
|---|---|---|
| A15 | 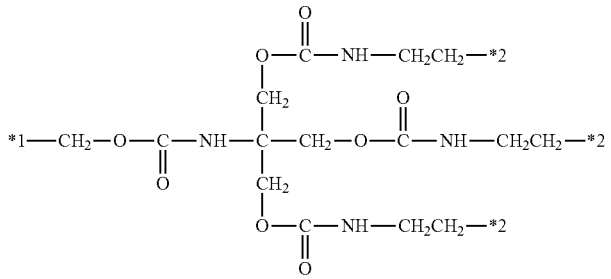 | 388.4 |
| A16 | 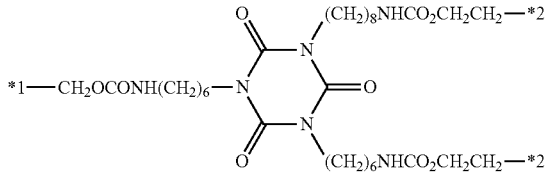 | 625.7 |

The radical-polymerizable group X is not specifically limited as long as it is a radical-polymerizable group having a carbon-carbon double bond, and is preferably an organic group having a structure represented by the following General Formula (2).

[Chemical Formula 6]

General Formula (2)

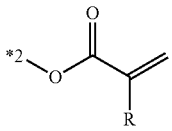

In General Formula (2), R represents a hydrogen atom or a methyl group, and *2 represents a binding site to the linking group A.

m and n each represents an integer of 0 or more, and is preferably an integer of 2 to 20, more preferably an integer of 2 to 15.

q represents an integer of 1 or more, and is preferably an integer of two or more. By having two or more radical-polymerizable groups at the both terminals of the PFPE chain, the PFPE chain can have more reaction points with a radical-polymerizable monomer and radical-polymerizable metal oxide microparticles, which will be mentioned below, and thus the wearing resistance and cleaning property of the electrophotographic photosensitive body can be enhanced.

Furthermore, in General Formula (1), the perfluoroethylene ether structural unit and the perfluoromethylene ether structural unit may form a block copolymer structure, or may form a random copolymer structure.

Examples of the radical-polymerizable PFPE include Fluorolink AD1700, MD500, MD700, 5101X and 5113X, and Fomblin MT70 manufactured by Solvay Specialty Polymers (both "FLUOROLINK" and "FOMBLIN" are the registered trademarks of this company), Optool DAC manufactured by Daikin Industries, Ltd., and KY-1203 manufactured by Shin-Etsu Chemical Co., Ltd., and Megafac RS-78 and Megafac RS-90 manufactured by DIC Corporation.

Alternatively, the radical-polymerizable PFPE can also be appropriately synthesized by using a PFPE having a hydroxy group or a carboxy group at the terminals, and such a synthesized product may also be used.

Examples of the PFPE having a hydroxy group at the terminal include Fomblin D2, Fluorolink D4000, E10H, 5158X and 5147X, and Fomblin Z-tetraol manufactured by Solvay Specialty Polymers, and Demnum-SA manufactured by Daikin Industries, Ltd.

Examples of the PFPE having carboxy groups at the terminals include Fomblin ZDIZAC4000 manufactured by Solvay Specialty Polymers, and Demnum-SH manufactured by Daikin Industries, Ltd.

In the radical-polymerizable composition, where the content of the radical-polymerizable PFPE is too small, the cleaning property of the photosensitive body sometimes becomes insufficient, whereas where the content is too much, the wearing resistance and scratch resistance of the photosensitive body sometimes become insufficient. From the viewpoint of sufficiently expressing cleaning property, the content of the radical-polymerizable PFPE is preferably 10 parts by mass or more, more preferably 20 parts by mass or more with respect to 100 parts by mass of the radical-polymerizable monomer. Furthermore, from the viewpoint of sufficiently expressing wearing resistance, the content of the radical-polymerizable PFPE is preferably 100 parts by mass or less, more preferably 50 parts by mass or less with respect to 100 parts by mass of the radical-polymerizable monomer.

As specific examples of the radical-polymerizable PFPE that can be applied to the protective layer according to the present invention, the following compounds PFPE-1 to to PFPE-12 are shown below. In the following compounds PFPE-1 to PFPE-12, X represents an acryloyloxy group or a methacryloyloxy group.

[Chemical Formula 7]

PFPE-1

$XCH_2—CF_2O(CF_2CF_2O)_m(CF_2O)_nCF_2—CH_2X$

PFPE-2

$X(CH_2CH_2O)_pCH_2—CF_2O(CF_2CF_2O)_m(CF_2O)_nCF_2—CH_2(OCH_2CH_2)_pX$

PFPE-3

$XCH_2CH_2NHCOOCH_2—CF_2O(CF_2CF_2O)_m(CF_2O)_nCF_2—CH_2OCONHCH_2CH_2X$

PFPE-4

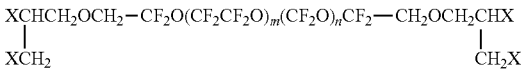

PFPE-5

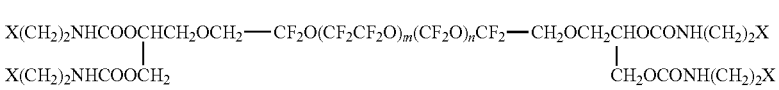

PFPE-6

$(XCH_2)_2(CH_3)CNHCOOCH_3—CF_2O(CF_2CF_2O)_m(CF_2O)_nCF_2—CH_2OCONHC(CH_3)(CH_2X)_2$

PFPE-7

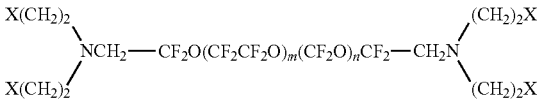

PFPE-8

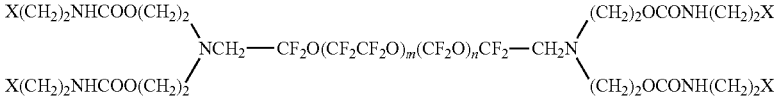

PFPE-9

$(XCH_2)_2CHO_2C—CF_2O(CF_2CF_2O)_m(CF_2O)_nCF_2—CO_2CH(CH_2X)_2$

PFPE-10

$(XCH_2)_3CCH_2O_2C—CF_2O(CF_2CF_2O)_m(CF_2O)_nCF_2—CO_2CH_2C(CH_2X)_3$

PFPE-11

$CF_3CF_2CF_2CF_2O(CF_2CF_2CF_2O)_nCF_2CF_2—CH_2OCONHC(CH_3)(CH_2X)_2$

PFPE-12

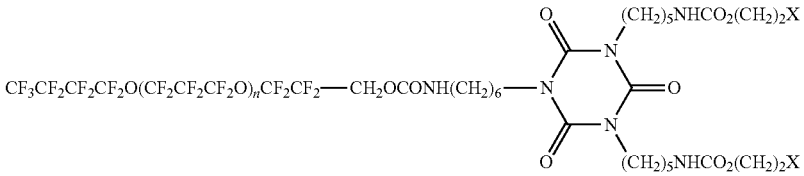

(Radical Polymerizable Monomer)

The radical-polymerizable monomer according to the present invention is a compound that has radical-polymerizable group(s) and is radical-polymerized (cured) upon irradiation with ultraviolet ray or visible ray, actinic ray such as electrons or the like or by application of energy such as heating or the like to give a resin that is generally used as a binder resin for a photosensitive body.

Examples of the radical-polymerizable monomer include styrene-based monomers, acryl-based monomers, methacryl-based monomers, vinyl toluene-based monomers, vinyl acetate-based monomers and N-vinylpyrrolidone-based monomers.

Examples of the binder resin include polystyrenes and polyacrylates.

The radical-polymerizable group is, for example, a radical-polymerizable group having a carbon-carbon double bond. It is specifically preferable that the radical-polymerizable group is an acryloyl group ($CH_2$═CHCO—) or a methacryloyl group ($CH_2$═C($CH_3$)CO—) since curing is possible at a low amount of light or in a short time.

Specific examples of the radical-polymerizable monomer include the following polymerizable monomers M1 to M11. In the following compound, R represents an acryloyl group, and R' represents a methacryloyl group.

[Chemical Formula 8]

M1

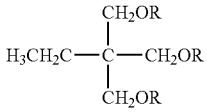

M2

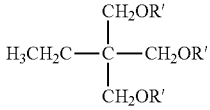

M3

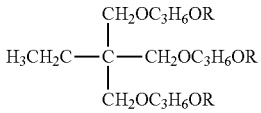

M4

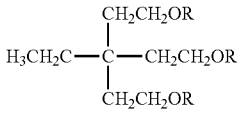

-continued

M5

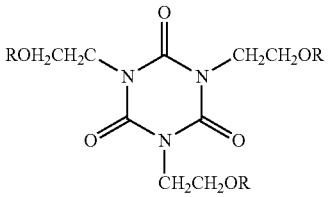

M6

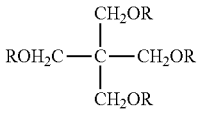

M7

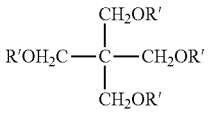

M8

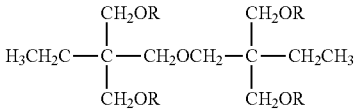

M9

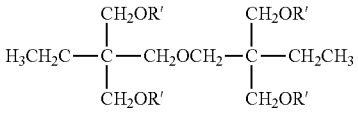

M10

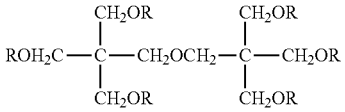

M11

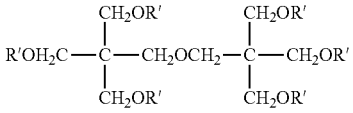

The radical-polymerizable monomer is known, and can also be obtained as a commercially available product. The radical-polymerizable monomer is preferably a compound having three or more radical-polymerizable groups from the viewpoint of forming a protective layer having a high crosslinking density and a high hardness.

The lower limit value of the content of the radical-polymerizable monomer in the radical-polymerizable composition is preferably 5% by mass or more, more preferably 10% by mass or more, specifically preferably 20% by mass or more with respect to the total solid content of the radical-polymerizable composition. Furthermore, the upper limit value of the content in the radical-polymerizable composition is preferably 80% by mass or less, more preferably 70% by mass or less, and specifically preferably 60% by mass or less.

(Metal Oxide Particles)

It is preferable that the radical-polymerizable composition according to the present invention further contains metal oxide particles.

The metal in the metal oxide particles also includes transition metals. The metal oxide particles may be used by solely one kind, or in combination of two or more kinds.

Examples of the metal oxide in the metal oxide particles include silica (silicon oxide), magnesium oxide, zinc oxide, lead oxide, alumina (aluminum oxide), tin oxide, tantalum oxide, indium oxide, bismuth oxide, yttrium oxide, cobalt oxide, copper oxide, manganese oxide, selenium oxide, iron oxide, zirconium oxide, germanium oxide, titanium dioxide, niobium oxide, molybdenum oxide, vanadium oxide and copper-aluminum composite oxide. Among these, the metal oxide is preferably alumina ($Al_2O_3$), tin oxide ($SnO_2$), titanium dioxide ($TiO_2$) or copper-aluminum composite oxide ($CuAlO_2$).

The number average primary particle size of the metal oxide particles is in the range of 1 to 300 nm, especially preferably in the range of 3 to 100 nm.

The number average primary particle size of the metal oxide particles may be a catalogue value, or can be obtained as follows. Specifically, a 10,000-fold enlarged photograph taken by a scanning electron microscope (JEOL Ltd.) is scanned by a scanner, and images of 300 particles except for flocculated particles from the obtained photograph images are randomly subjected to a binarization processing by using an automatic image processing analysis system (Luzex AP, Nireco ("LUZEX" is the registered trademark by this company), Software Ver. 1.32), the horizontal Feret diameters of said respective particle images are calculated, and an average value thereof is calculated and set as a number average primary particle size. The horizontal Feret diameter herein refers to a length of a side in parallel to the axis x of a circumscribed rectangle where a particle image is subjected to the binarization processing.

In the radical-polymerizable composition, if the content of the metal oxide particles is too small, the wearing resistance of the photosensitive body sometimes becomes insufficient. Alternatively, if the content of the metal oxide particles is too much, the content of the PFPE in the protective layer becomes relatively low, and consequently, the cleaning property of the photosensitive body sometimes becomes insufficient. From the viewpoint of sufficiently expressing the mechanical strength of the protective layer and attaining a suitable electrical resistance, the lower limit of the content of the metal oxide particles in the radical-polymerizable composition is preferably 45 parts by mass or more with respect to the total amount (100 parts by mass) of the radical-polymerizable monomer and the radical-polymerizable PFPE. Furthermore, from the viewpoint of sufficiently expressing cleaning property, the upper limit of the content of the metal oxide particles is preferably 150 parts by mass or less.

It is preferable that the metal oxide particles are metal oxide particles having radical-polymerizable groups (hereinafter also referred to as radical-polymerizable metal oxide particles). The radical-polymerizable metal oxide particles each has a metal oxide particle, and a carried body, which is carried by the surface of the particle and contains radical-polymerizable groups. The carrying of the carried body containing radical-polymerizable groups on the surface of the metal oxide particle may be physical carrying or may be chemical bonding. The radical-polymerizable groups may be either one kind or two or more, and may be the same or different.

In the protective layer, the radical-polymerizable metal oxide particles are present in the state that the metal oxide particles are chemically bound to an integral polymer constituting the protective layer via surface modifier residues which the metal oxide particles have on the surfaces thereof. The surface modifier residue is, for example, a molecular structure that is chemically bound to the surfaces of the metal oxide particles, and is a moiety derived from the surface modifier.

The carried body on the surfaces of the metal oxide particles can be carried by a known technology for a surface treatment of the metal oxide particles. For example, said carrying can be conducted by a known method for surface treating metal oxide particles with a surface modifier as described in JP 2012-078620 A.

The surface modifier has a radical-polymerizable group and a surface modifying group. A surface modifier may be used solely, or two or more kinds of surface modifiers may be used in combination. The surface modifying group is a functional group having reactivity with polar groups such as a hydroxy group which are present on the surfaces of the metal oxide particles. The radical-polymerizable group is a radical polymerizable group having a carbon-carbon double bond as in the radical-polymerizable group of the radical-polymerizable monomer or PFPE, and examples include a vinyl group, an acryloyl(oxy) group and a methacryloyl (oxy) group.

As the surface modifier, a silane coupling agent having a radical-polymerizable group is preferable, and examples include the following compounds S-1 to S-31.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OC_2H_5)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$ (Method for Forming PFPE Domain)

The presence or absence of the formation and the size of the domain diameter of the PFPE domain can be controlled by the degree of compatibility and mixing ratio of the binder resin that constitutes the protective layer (or the radical-polymerizable monomer that constitutes the binder resin) and the PFPE, the types of an application solvent, and the like.

If the compatibility of the binder resin and the PFPE is too high, an even coating is formed, but a PFPE domain is not generated. In a case where the compatibility of the binder resin and the PFPE is too low, phase separation may occur in the application liquid for forming a protective layer, and shedding may occur during application. By the suitable compatibility of the PFPE and the binder resin, a preferable PFPE domain can be formed.

The compatibility of the binder resin and the PFPE is significantly affected by the structure of the PFPE. For example, the compatibility can be controlled by the perfluoroalkylene repeating unit structure, the molecular weight, the number of the radical-polymerizable groups, the structure of the linking group that links the PFPE chain and the radical-polymerizable group, and the like of the PFPE.

Furthermore, in a case where the compatibility of the binder resin and the PFPE is low, a dispersant may be used for forming a PFPE domain in the protective layer of the photosensitive body more stably.

The dispersant is a compound having a moiety having affinity to a perfluoroalkyl chain and a hydrocarbon, i.e., an amphipathic compound having fluorophilicity and fluorophobicity, and a surfactant, an amphipathic block copolymer and an amphipathic graft copolymer are preferably used. Among these, (i) a block copolymer obtained by copolymerizing a vinyl monomer having a fluoroalkyl group and an acrylate or a methacrylate, or (ii) a comb-shaped graft copolymer obtained by copolymerizing an acrylate or methacrylate having a fluoroalkyl group and a methacrylate macromonomer having polymethyl methacrylate at the side chains is preferable. Examples of the block copolymer of the above-mentioned (i) include "Modiper F200", "Modiper F210", "Modiper F2020", "Modiper F600" and "Modiper FT-600" manufactured by NOF Corporation. Furthermore, examples of the comb-shaped graft copolymer of the above-mentioned (ii) and the fluorine-based graft polymer include "Aron GF-150", "Aron GF-300" and "Aron GF-400" manufactured by Toa Gosei Co., Ltd.

Since the dispersant sometimes decreases the wearing resistance of the protective layer and deteriorates the potential property of the photosensitive body, the content of the dispersant is preferably 20 parts by mass or less, more preferably 10 parts by mass or less with respect to the total amount (100 parts by mass) of the radical-polymerizable monomer and the PFPE having radical-polymerizable groups.

The PFPE domain diameter can also be controlled by the addition amount of the dispersant.

<Electroconductive Support>

The electroconductive support of the present invention may be any one having electroconductivity, and examples include electroconductive supports obtained by molding a metal such as aluminum, copper, chromium, nickel, zinc or stainless steel into a drum or sheet shape, electroconductive supports obtained by laminating a metal foil of aluminum, copper or the like onto a plastic film, electroconductive supports obtained by depositing aluminum, indium oxide, tin oxide or the like onto a plastic film, and metals, plastic films or paper sheets on which an electroconductive layer is disposed by applying an electroconductive substance solely or together with a binder resin, and the like.

<Intermediate Layer>

In the electrophotographic photosensitive body of the present invention, an intermediate layer having a barrier function and an adhesion function can be disposed between the electroconductive support and the photosensitive layer. Considering prevention of various malfunctions and the like, it is preferable to dispose an intermediate layer.

Such intermediate layer contains, for example, a binder resin (hereinafter also referred to as a binder resin for an intermediate layer), and electroconductive particles and metal oxide particles as necessary.

Examples of the binder resin for an intermediate layer include casein, polyvinyl alcohols, nitrocellulose, ethylene-acrylic acid copolymers, polyamide resins, polyurethane resins, gelatin and the like. Among these, alcohol-soluble polyamide resins are preferable.

The intermediate layer can contain various electroconductive particles and metal oxide particles for the purpose of adjusting resistance. For example, particles of various metal oxides such as alumina, zinc oxide, titanium oxide, tin oxide, antimony oxide, indium oxide and bismuth oxide can be used. Furthermore, ultramicroparticles such as tin-doped indium oxide, and antimony-doped tin oxide or zirconium oxide can be used.

The number average primary particle size of such metal oxide particles is, for example, preferably 0.3 μm or less, more preferably 0.1 μm or less. The number average primary particle size of said metal oxide particles can be measured by a method similar to the method for measuring the number average primary particle size of the metal oxide particles contained in the protective layer.

These metal oxide particles can be used by solely one kind, or by mixing two or more kinds. In a case where two or more kinds are mixed, the mixed metal oxide particles may have a solid-solution form or a fused form.

The content ratio of the electroconductive particles or metal oxide particles is, for example, preferably in the range of 20 to 400 parts by mass, more preferably in the range of 50 to 350 parts by mass with respect to 100 parts by mass of the binder resin for an intermediate layer.

The thickness of the intermediate layer is, for example, preferably in the range of 0.1 to 15 μm, more preferably in the range of 0.3 to 10 μm.

<Charge Generating Layer>

The charge generating layer contains a charge generating substance and a binder resin (hereinafter also referred to as a binder resin for a charge generating layer).

Examples of the charge generating substance include, but are not limited to, azo raw materials such as Sudan Red and Diane Blue quinone pigments such as pyrenequinone and antanthrone, quinocyanine pigments, perylene pigments, indigo pigments such as indigo and thioindigo, polycyclic quinone pigments such as pyranthrone and diphthaloylpyrene, phthalocyanine pigments, and the like. Among these, polycyclic quinone pigments and phthalocyanine pigments are preferable.

These charge generating substances can be used by solely one kind, or by mixing or two or more kinds.

As the binder resin for a charge generating layer, a known resin can be used, and examples include, but are not limited to, polystyrene resins, polyethylene resins, polypropylene resins, acrylic resins, methacrylic resins, vinyl chloride resins, vinyl acetate resins, polyvinylbutyral resins, epoxy resins, polyurethane resins, phenolic resins, polyester resins, alkyd resins, polycarbonate resins, silicone resins, melamine resins, or copolymer resins containing two or more of these resins (for example, vinyl chloride-vinyl acetate copolymer resins, vinyl chloride-vinyl acetate-maleic anhydride copolymer resins), polyvinylcarbazole resins and the like. Among these, polyvinylbutyral resins are preferable.

The content ratio of the charge generating substance in the charge generating layer is, for example, preferably in the range of 1 to 600 parts by mass, more preferably in the range of 50 to 500 parts by mass with respect to 100 parts by mass of the binder resin for a charge generating layer.

The thickness of the charge generating layer differs depending on the property of the charge generating substance, the property of the binder resin for a charge generating layer, the content ratio, and the like, and is for example, preferably in the range of 0.01 to 5 μm, more preferably in the range of 0.05 to 3 μm.

<Charge Transporting Layer>

The charge transporting layer contains a charge transporting substance and a binder resin (hereinafter also referred to as a binder resin for a charge transporting layer).

Examples of the charge transporting substance include substances that transport electrical charge such as triphenylamine derivatives, hydrazone compounds, styryl compounds, benzidine compounds, butadiene compounds and the like.

As the binder resin for a charge transporting layer, a known resin can be used, and examples include polycarbonate resins, polyacrylate resins, polyester resins, polystyrene resins, styrene-acrylonitrile copolymer resins, polymethacrylic acid ester resins, styrene-methacrylic acid ester copolymer resins and the like, and polycarbonate resins are preferable. Furthermore, BPA (bisphenol A) type, BPZ (bisphenol Z) type, dimethyl BPA type, BPA-dimethyl BPA copolymer type polycarbonate resins and the like are preferable in view of crack resistance, wear resistance and charging property.

The content ratio of the charge transporting substance in the charge transporting layer is, for example, preferably in the range of 10 to 500 parts by mass, more preferably in the range of 20 to 250 parts by mass, with respect to 100 parts by mass of the binder resin for a charge transporting layer.

The thickness of the charge transporting layer differs depending on the property of the charge transporting substance, the property of the binder resin for a charge transporting layer, the content ratio, and the like, and is, for example, preferably in the range of 5 to 40 μm, more preferably in the range of 10 to 30 μm.

An antioxidant, an electronconductant agent, a stabilizer, a silicone oil and the like may also be added into the charge transporting layer. For example, the antioxidants disclosed in JP 2000-305291 A and the like are preferable, and the electronconductant agents disclosed in JP 50-137543 A, JP 58-76483 A and the like are preferable.

<<Method for Producing Electrophotographic Photosensitive Body>>

The electrophotographic photosensitive body of the present invention can be produced by, for example, conducting the following steps.

Step (1): a step of forming an intermediate layer by applying an application liquid for forming an intermediate layer onto an outer periphery surface of an electroconductive support, and drying the application liquid for forming an intermediate layer Step (2): a step of forming a charge generating layer by applying an application liquid for forming a charge generating layer onto an outer periphery surface of the intermediate layer that has been formed on the electroconductive support, and drying the application liquid for forming a charge generating layer Step (3): a step of forming a charge transporting layer by applying an application liquid for forming a charge transporting layer onto an outer periphery surface of the charge generating layer that has been formed on the intermediate layer, and drying the application liquid for forming a charge transporting layer Step (4): a step of forming a protective layer by applying an application liquid for forming a protective layer onto an outer periphery surface of the charge transporting layer that has been formed on the charge generating layer to form a coating, and subjecting this coating to a curing treatment Hereinafter the respective steps will be explained.

(Step (1): Step of Forming Intermediate Layer)

The intermediate layer can be formed by preparing an application liquid for forming an intermediate layer by dissolving a binder resin for an intermediate layer in a solvent, dispersing electroconductive particles or metal oxide particles as necessary, applying said application liquid onto an electroconductive support to a constant film thickness to form a coating, and drying said coating.

As a means for dispersing the electroconductive particles and metal oxide particles in the application liquid for forming an intermediate layer, an ultrasonic dispersing machine, a ball mill, a sand mill, a homomixer and the like can be used, but the means is not limited to these.

Examples of the method for applying the application liquid for forming an intermediate layer include known methods such as an immersion coating process, a spray coating process, a spinner coating process, a bead coating process, a blade coating process, a beam coating process, a slide hopper process and a circular slide hopper process.

The method for drying the coating can be suitably selected depending on the kind of the solvent and the film thickness, and thermal drying is preferable.

The solvent used in the step for forming the intermediate layer may be any solvent that finely disperses electroconductive particles and metal oxide particles, and dissolves the binder resin for an intermediate layer. Specifically, alcohols having 1 to 4 carbon atoms such as methanol, ethanol, n-propyl alcohol, isopropyl alcohol, n-butanol, t-butanol and sec-butanol are preferable since they have excellent property to dissolve the binder resin and excellent application performance. Furthermore, examples of co-solvents that can be used in combination with the above-mentioned solvent for improving storage property and property to disperse particles include benzyl alcohol, toluene, methylene chloride, cyclohexanone, tetrahydrofuran and the like.

The concentration of the binder resin for an intermediate layer in the application liquid for forming an intermediate layer is suitably selected according to the thickness of the intermediate layer and the production velocity.

(Step (2): Step for forming Charge Generating Layer)

The charge generating layer can be formed by dispersing a charge generating substance in a solution of a binder resin for a charge generating layer dissolved in a solvent to prepare an application liquid for forming a charge generating layer, applying said application liquid onto an intermediate layer at a predetermined film thickness to form a coating, and drying said coating.

As a means for dispersing the charge generating substance in the application liquid for forming a charge generating layer, for example, an ultrasonic dispersing machine, a ball mill, a sand mill, a homomixer and the like can be used, but the means is not limited to these.

Examples of the method for applying the application liquid for forming a charge generating layer include known methods such as a dip coating process, a spray coating process, a spinner coating process, a bead coating process, a blade coating process, a beam coating process, a slide hopper process and a circular slide hopper process.

The method for drying the coating can be suitably selected depending on the kind of the solvent and the film thickness, and thermal drying is preferable.

Examples of the solvent used for the formation of the charge generating layer include, but are not limited to, toluene, xylene, methylene chloride, 1,2-dichloroethane, methyl ethyl ketone, cyclohexane, ethyl acetate, t-butyl acetate, methanol, ethanol, propanol, butanol, methylcellosolve, 4-methoxy-4-methyl-2-pentanone, ethylcellosolve, tetrahydrofuran, 1,4-dioxane, 1,3-dioxolane, pyridine and diethylamine.

(Step (3): Step for forming Charge Transporting Layer)

The charge transporting layer can be formed by dissolving a binder resin for a charge transporting layer and a charge transporting substance in a solvent to prepare an application liquid for forming a charge transporting layer, applying said application liquid onto a charge generating layer at a predetermined film thickness to form a coating, and drying said coating.

Examples of the method for applying the application liquid for forming a charge transporting layer include known methods such as a dip coating process, a spray coating process, a spinner coating process, a bead coating process, a blade coating process, a beam coating process, a slide hopper process and a circular slide hopper process.

The method for drying the coating can be suitably selected depending on the kind of the solvent and the film thickness, and thermal drying is preferable.

Examples of the solvent used for forming the charge transporting layer include, but are not limited to, toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, diethylamine and the like.

(Step (4): Step for forming Protective Layer)

The protective layer can be formed by, for example, adding a radical-polymerizable composition containing a radical-polymerizable monomer and a radical-polymerizable PFPE, and other components as necessary to a known solvent to prepare an application liquid for forming a protective layer, applying this application liquid for forming a protective layer on an outer periphery surface of a charge transporting layer to form a coating, drying this coating, and irradiating this coating with actinic ray such as ultraviolet ray or electron beam to cure the polymerizable compound in the coating.

In the treatment for curing the protective layer, it is preferable that the radical-polymerizable compound in the coating is irradiated with ultraviolet ray to generate radicals to cause a polymerization reaction, and cured by forming crosslinking bonds by intermolecular and intramolecule crosslinking reactions, whereby said radical-polymerizable compound is formed as a crosslinking curable resin.

As a means for dispersing metal oxide particles and a charge transporting agent in the application liquid for forming a protective layer, an ultrasonic dispersing machine, a ball mill, a sand mill, a homomixer and the like can be used, but the means is not limited to these.

Examples of the method for applying the application liquid for forming a protective layer include known methods such as a dip coating process, a spray coating process, a spinner coating process, a bead coating process, a blade coating process, a beam coating process, a slide hopper process and a circular slide hopper process.

The curing treatment can also be conducted without drying the coating, but it is preferable to conduct the curing treatment after natural drying or thermal drying has been conducted.

The conditions for the drying can be suitably selected depending on the kind of the solvent, the film thickness and the like. The drying temperature is preferably in the range of room temperature (25° C.) to 180° C., especially preferably in the range of 80 to 140° C. The drying time is preferably 1 to 200 minutes, especially preferably 5 to 100 minutes.

As the ultraviolet light source, any light source can be used without limitation as long as it is a light source that generates ultraviolet ray. For example, a low pressure mercury lamp, a middle pressure mercury lamp, a high pressure mercury lamp, an ultrahigh pressure mercury lamp, a carbon arc lamp, a metal halide lamp, a xenon lamp, flash (pulse) xenon and the like can be used.

The condition for the irradiation differs depending on the respective lamps. For example, the irradiation dose of ultraviolet ray is generally in the range of 5 to 500 $mJ/cm^2$, preferably in the range of 5 to 100 $mJ/cm^2$.

The electrical power of the lamp is preferably in the range of 0.1 to 5 kW, especially preferably in the range of 0.5 to 3 kW.

The irradiation time for obtaining a necessary amount of irradiation of ultraviolet ray is preferably 0.1 second to 10 minutes, more preferably 0.1 second to 5 minutes in view of working efficiency.

In the step of forming the protective layer, the drying can be conducted before or after the irradiation with ultraviolet ray, and during the irradiation with ultraviolet ray, and the timing for conducting the drying can be suitably selected by combining these.

The application liquid for forming a protective layer may further contain components other than the radical-polymerizable composition within a scope in which the effect of the present invention is not inhibited. Examples of said other components include solvents and polymerization initiators.

Examples of the solvent include methanol, ethanol, n-propyl alcohol, isopropyl alcohol, n-butanol, t-butanol, sec-butanol, benzyl alcohol, toluene, xylene, methyl ethyl ketone, cyclohexane, ethyl acetate, butyl acetate, methylcellosolve, ethylcellosolve, tetrahydrofuran, 1,3-dioxane, 1,3-dioxolane, pyridine, diethylamine and the like. One solvent may be used solely, or two or more kinds of solvents may be used in combination.

The polymerization initiator can be suitably determined from known polymerization initiators depending on the step of producing the protective layer. Examples of the polymerization initiator include photopolymerization initiators, thermal polymerization initiators and polymerization initiators that can initiate polymerization by both light and heat.

Examples of the polymerization initiators include azo compounds such as 2,2'-azobisisobutyronitrile, 2,2'-azobis(2,4-dimethylazobisvaleronitrile) and 2,2'-azobis(2-methylbutyronitrile), and peroxides such as benzoyl peroxide (BPO), di-tert-butylhydroperoxide, tert-butylhydroperoxide, chlorobenzoyl peroxide, dichlorobenzoyl peroxide, bromomethylbenzoyl peroxide and lauroyl peroxide, and the like.

Furthermore, as the polymerization initiator, an acetophenone-based or ketal-based photopolymerization initiator can be used, and specific examples include diethoxyacetophenone, 2,2-dimethoxy-1,2-diphenylethan-1-one, 1-hydroxycyclohexylphenylketone, 4-(2-hydroxyethoxy)phenyl-(2-hydroxy-2-propyl)ketone, 2-benzyl-2-dimethylamino-1-(4-morpholinophenyl)butanone-1 (Irgacure 369; BASF Japan, "Irgacure" is a registered trademark of BASF), 2-hydroxy-2-methyl-1-phenylpropan-1-one, 2-methyl-2-morpholino(4-methylthiophenyl)propan-1-one and 1-phenyl-1,2-propanedione-2-(o-ethoxycarbonyl)oxime.

Furthermore, examples of the polymerization initiator include benzoin ether-based photopolymerization initiators such as benzoin, benzoin methyl ether, benzoin ethyl ether, benzoin isobutyl ether and benzoin isopropyl ether, and benzophenone-based photopolymerization initiators such as benzophenone, 4-hydroxybenzophenone, o-benzoylmethyl benzoate, 2-benzoylnaphthalene, 4-benzoylbiphenyl, 4-benzoyl phenyl ether, acrylated benzophenone and 1,4-benzoylbenzene.

Furthermore, examples of the polymerization initiator include thioxanthone-based photopolymerization initiators such as 2-isopropylthioxanthone, 2-chlorothioxanthone, 2,4-dimethylthioxanthone, 2,4-diethylthioxanthone and 2,4-dichlorothioxanthone.

Furthermore, examples of the polymerization initiator include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxy ester, 9,10-phenanthrene, acridine-based compounds, triazine-based compounds, imidazole-based compounds and the like.

Furthermore, for the photopolymerization initiator, a photopolymerization promotor having a photopolymerization-promoting effect may be used in combination. Examples of the photopolymerization promotor include triethanolamine, methyldiethanolamine, ethyl 4-dimethylamino benzoate, isoamyl 4-dimethylaminobenzoate, (2-dimethylamino)ethylbenzoate, 4,4'-dimethylaminobenzophenone and the like.

The polymerization initiator is preferably a photopolymerization initiator, preferably an alkylphenone-based compound or a phosphine oxide-based compound, further preferably a polymerization initiator having an α-hydroxyacetophenone structure, or a polymerization initiator having an acylphosphine oxide structure.

The content of the polymerization initiator in the radical-polymerizable composition is preferably in the range of 0.1 to 40 parts by mass, more preferably in the range of 0.5 to 20 parts by mass with respect to 100 parts by mass of the radical-polymerizable monomer.

One polymerization initiator may be solely used, or two or more kinds of polymerization initiators may be used in combination.

<<Image Forming Apparatus>>

The image forming apparatus of the present invention is constituted by including the above-mentioned electrophotographic photosensitive body. It is preferable that the image forming apparatus of the present invention further includes a first charging means for charging a surface of said electrophotographic photosensitive body; an exposing means for irradiating the surface of said electrophotographic photosensitive body with light to form an electrostatic latent image; a developing means for developing an electrostatic latent image with a toner to form a toner image; a transfer means for transferring the toner image on a paper sheet; a second charging means for charging the surface of the electrophotographic photosensitive body after the toner image has been transferred onto the paper sheet; and a cleaning means for removing the residual toner on the electrophotographic photosensitive body.

Figure 3:
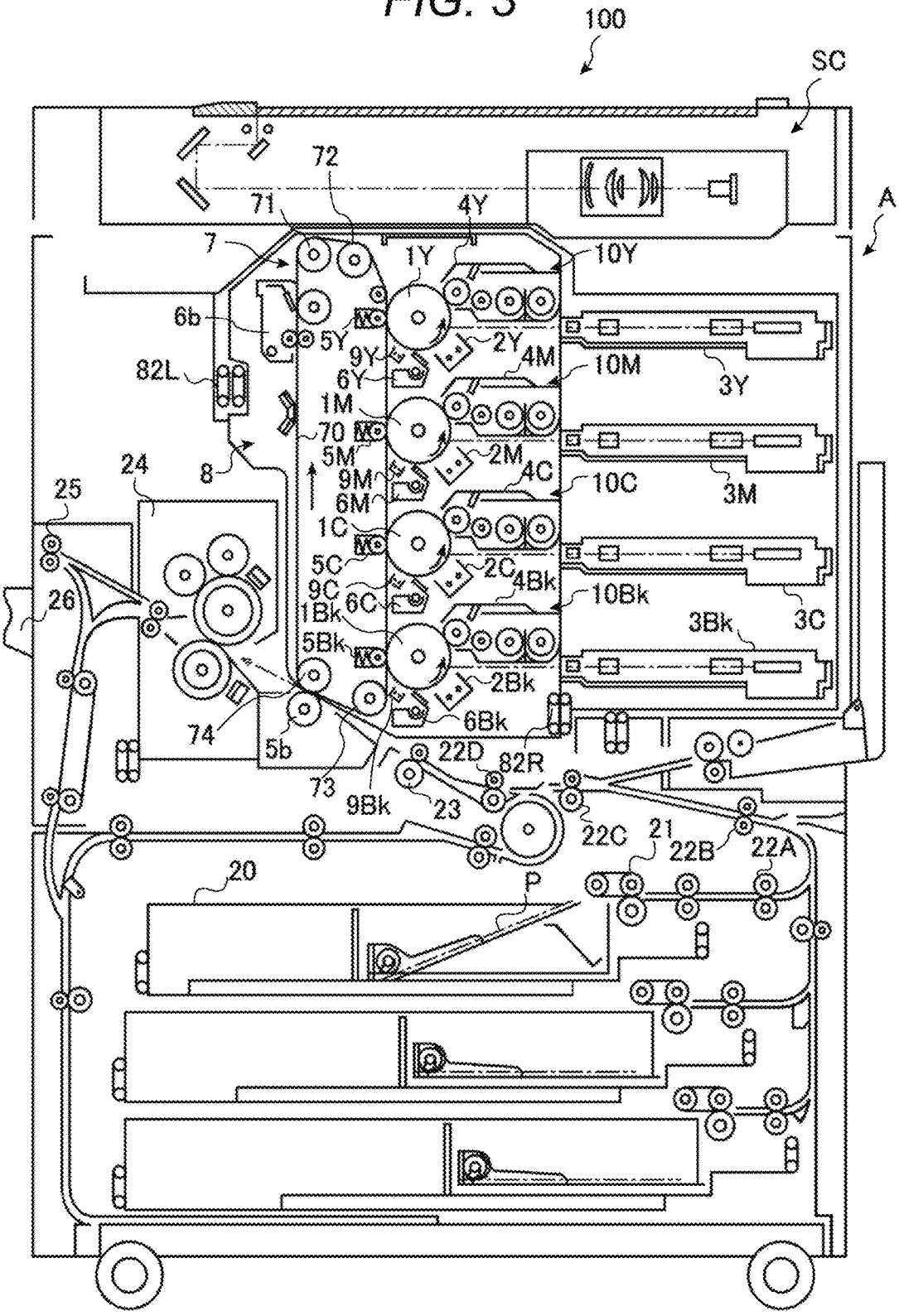
FIG. 3 is a schematic drawing showing an example of an image forming apparatus according to an embodiment of the present invention.

FIG. 3 is a schematic drawing showing an example of the image forming apparatus of the present invention.

The image forming apparatus 100 is referred to as a tandem-type color image forming apparatus, and includes four sets of image forming units 10Y, 10M, 10C and 10Bk, an endless belt-shaped intermediate transfer body unit 7, a paper feeding means 21, a fixing means 24 and the like. A document image reading apparatus SC is disposed on the upper part of an apparatus main body A of the image forming apparatus 100.

The image forming unit 10Y that forms a yellow image has a first charging means 2Y, an exposing means 3Y, a developing means 4Y, a primary transfer roller 5Y, a second charging means 9Y and a cleaning means 6Y that are sequentially disposed along the rotational direction of a drum-shaped photosensitive body 1Y around the photosensitive body 1Y.

The image forming unit 10M that forms a magenta image has a first charging means 2M, an exposing means 3M, a developing means 4M, a primary transfer roller 5M, a second charging means 9M and a cleaning means 6M that are sequentially disposed along the rotation direction of a drum-shaped photosensitive body 1M around the photosensitive body 1M.

The image forming unit 10C that forms a cyan image has a first charging means 2C, an exposing means 3C, a developing means 4C, a primary transfer roller 5C, a second charging means 9C and a cleaning means 6C that are sequentially disposed along the rotation direction of a drum-shaped photosensitive body 1C around the photosensitive body 1C.

The image forming unit 10Bk that forms a black image has a first charging means 2Bk, an exposing means 3Bk, a developing means 4Bk, a primary transfer roller 5Bk, a second charging means 9Bk and a cleaning means 6Bk that are sequentially disposed along the rotation direction of a drum-shaped photosensitive body 1Bk around the photosensitive body 1Bk.

As the photosensitive bodies 1Y, 1M, 1C and 1Bk, the above-mentioned electrophotographic photosensitive body of the present invention is used.

The image forming units 10Y, 10M, 10C and 10Bk are similarly constituted with only differences in the colors of toner images formed on the photosensitive bodies 1Y, 1M, 1C and 1Bk. Accordingly, the image forming unit 10Y will be explained in detail as an example, and the explanations on the image forming units 10M, 10C and 10Bk will be omitted.

The image forming unit 10Y includes a first charging means 2Y, an exposing means 3Y, a developing means 4Y, a primary transfer roller 5Y, a second charging means 9Y and a cleaning means 6Y that are disposed around the photosensitive body 1Y as an image forming body, and forms a yellow (Y) toner image on the photosensitive body 1Y. Furthermore, in the present exemplary embodiment, in the image forming unit 10Y, at least the photosensitive body 1Y, the first charging means 2Y, the developing means 4Y, the second charging means 9Y and the cleaning means 6Y are integrated and disposed.

The first charging means 2Y is a means for applying an even potential to the photosensitive body 1Y, and for example, a corona-discharging type charger is used.

The exposing means 3Y is a means for forming an electrostatic latent image that corresponds to a yellow image by conducting exposure based on an image signal (yellow) on the photosensitive body 1Y to which an even potential has been provided by the first charging means 2Y. As the exposing means 3Y, for example, an exposing means constituted by an LED including light-emitting elements that are arranged in arrays in the axial direction of the photosensitive body 1Y and an imaging element, or a laser optical system is used.

The developing means 4Y is constituted by, for example, a developing sleeve including magnet therein, which retains and rotates a developer, and a voltage applying apparatus that applies a direct current and/or alternate current bias the voltage to between photosensitive body 1Y and this developing sleeve.

The primary transfer roller 5Y is a means for transferring the toner image that has been formed on the photosensitive body 1Y to an endless belt-shaped intermediate transfer body 70. The primary transfer roller 5Y is disposed with abutting to the intermediate transfer body 70.

The second charging means 9Y is a means for a charge removal means that removes the charge on the surface of the photosensitive body 1Y after the toner image has been transferred to the intermediate transfer body 70, and is disposed as a precleaning element. As the second charging means 9Y, for example, a corona-discharging type charger is used.

According to the image forming apparatus of the present invention 100, since the image forming apparatus includes the electrophotographic photosensitive body of the present invention and also includes the second charging means 9Y, sufficiently long lifetime of the photosensitive body and high-quality image can be obtained. Furthermore, since the image forming apparatus 100 includes the electrophotographic photosensitive body of the present invention, sufficiently long lifetime of the photosensitive body and high-quality image can be obtained even under an image form condition in which the second charging means 9Y is not provided, or the second charging means 9Y is not used.

The cleaning means 6Y is constituted by a cleaning blade, and a brush roller that is disposed upstream of this cleaning blade.

The endless belt-shaped intermediate transfer body unit 7 is wound around a plurality of rollers 71, 72, 73 and 74 to have an endless belt-shaped intermediate transfer body 70 as a semiconductive endless belt-shaped second image carrier that is rotatably supported. A cleaning means 6*b* for removing a toner is disposed on the intermediate transfer body 70 in the endless belt-shaped intermediate transfer body unit 7.

Furthermore, a chassis 8 is constituted by the above-mentioned image forming units 10Y, 10M, 10C and 10Bk and the endless belt-shaped intermediate transfer body unit 7. The chassis 8 is constituted to be drawable from the apparatus main body A via supporting rails 82L and 82R.

Examples of fixing means 24 include, for example, a fixing means having a thermal roller fixing system constituted by a heating roller having a heat source inside and a pressurizing roller that is disposed on this heating roller in a pressure-contacted state so that a fixing nip part is formed.

Although the image forming apparatus 100 is a color laser printer in the above-mentioned exemplary embodiment, it may also be a monochrome laser printer, a copying machine, a complex machine or the like.

Furthermore, the exposing light source may be a light source other than laser such as an LED light source.

<<Image Forming Method>>

An image can be formed as follows by using the image forming apparatus 100 including the electrophotographic photosensitive body of the present invention.

Specifically, at first, an electrical current is discharged from the first charging means 2Y, 2M, 2C and 2Bk onto the surfaces of the photosensitive bodies 1Y, 1M, 1C and 1Bk so that the surfaces are negatively charged. Subsequently, the surfaces of the photosensitive bodies 1Y, 1M, 1C and 1Bk are exposed to light by the exposing means 3Y, 3M, 3C and 3Bk based on an image signal, whereby an electrostatic latent image is formed. Subsequently, toners are provided to the surfaces of the photosensitive bodies 1Y, 1M, 1C and 1Bk by the developing means 4Y, 4M, 4C and 4Bk to form toner images.

Subsequently, the toner images of the respective colors that have been respectively formed on the photosensitive bodies 1Y, 1M, 1C and 1Bk are sequentially transferred onto the rotating intermediate transfer body 70 (primary transfer) by the primary transfer rollers 5Y, 5M, 5C and 5Bk, whereby a color image is formed on the intermediate transfer body 70.

Furthermore, the charge on the surfaces of the photosensitive bodies 1Y, 1M, 1C and 1Bk is removed by the second charging means 9Y, 9M, 9C and 9Bk. Thereafter the toners remaining on the surfaces of the photosensitive bodies 1Y, 1M, 1C and 1Bk are removed by the cleaning means 6Y, 6M, 6C and 6Bk. Thereafter, the photosensitive bodies 1Y, 1M, 1C and 1Bk are negatively charged by the charging means 2Y, 2M, 2C and 2Bk in preparation for the next image forming process.

On the other hand, a paper sheet P is fed from a paper feeding cassette 20 by a paper feeding means 21, and is carried to a secondary transfer roller 5*b* via a plurality of intermediate rollers 22A, 22B, 22C and 22D and a resist roller 23. Furthermore, a color image is transferred onto the paper sheet P by the secondary transfer roller 5*b* (secondary transfer).

The paper sheet P onto which the color image has been transferred is subjected to a fixing treatment via a fixing means 24, sandwiched between paper ejection rollers 25 and ejected to the outside of the apparatus, and mounted on a paper ejection tray 26. Furthermore, after the paper sheet P has been separated from the intermediate transfer body 70, the residual toner on the intermediate transfer body 70 is removed by the cleaning means 6*b*.

An image can be formed on the paper sheet P as above.

EXAMPLES

The present invention will be specifically explained below by Examples, but the present invention is not limited to these Examples.

<<Synthesis of Perfluoropolyether>>

Perfluoropolyethers PFPE-A to PFPE-G were synthesized as follows.

<Synthesis of PFPE-A (Compound PFPE-3 (X=an acryloyloxy group))>

The following Two-terminal hydroxy group-containing perfluoropolyether (P-1) (14.4 parts by mass), 0.01 part by mass of p-methoxyphenol as a polymerization inhibitor, 0.01 part by mass of dibutyltin dilaurate as an urethane-forming catalyst, and 10 parts by mass of methyl ethyl ketone were mixed, stirring was started under an air flow, and the temperature was raised to 80° C.

[Chemical Formula 9]

$$HOCH_2—CF_2O(CF_2CF_2O)_m(CF_2O)_nCF_2—CH_2OH \qquad \text{P-1}$$

In the above-mentioned structural formula, an average value of m is 8, and an average value of n is 5.

Subsequently, a reaction was conducted by adding 2.8 parts by mass of 2-(acryloyloxy)ethylisocyanate, and stirring the mixture at 80° C. for 10 hours.

The disappearance of the absorption peak near 2,360 $cm^{-1}$ derived from an isocyanate group was confirmed by IR spectroscopy, and the solvent was distilled off, whereby 17.2 parts by mass of the following Perfluoropolyether (PFPE-A) was obtained.

[Chemical Formula 10]

$$XCH_2CH_2NHCOOCH_2—CF_2O(CF_2CF_2O)_m(CF_2O)_nCF_2—CH_2OCONHCH_2CH_2X \qquad \text{PFPE-A}$$

In the above-mentioned structural formula, an average value of m is 8, an average value of n is 5, and X is an acryloyloxy group.

<Synthesis of PFPE-B (Compound PFPE-5 (X=a Methacryloyloxy Group))>

The following Two-terminal hydroxy group-containing Perfluoropolyether (P-2) (21.8 parts by mass), 0.01 part by mass of p-methoxyphenol, 0.01 part by mass of dibutyltin dilaurate and 20 parts by mass methyl ethyl ketone were mixed, stirring was started under an air flow, and the temperature was raised to 80° C.

[Chemical Formula 11]

$$\begin{array}{l} HOCHCH_2OCH_2—CF_2O(CF_2CF_2O)_m(CF_2O)_nCF_2—CH_2OCH_2CHOH \\ \quad\;\; | \qquad\qquad\qquad\

[Chemical Formula 13]

P-2

$$\begin{array}{l} HOCHCH_2OCH_2{-}CF_2O(CF_2CF_2O)_m(CF_2O)_nCF_2{-}CH_2OCH_2CHOH \\ \quad\;\; | \qquad\qquad\qquad\

[Chemical Formula 20]

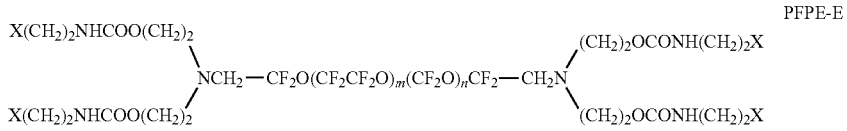

PFPE-E

In the above-mentioned structural formula, an average value of m is 8, an average value of n is 5, and X is an acryloyloxy group.

<Synthesis of PFPE-F (Compound PFPE-9 (X=an Acryloyloxy Group))>

The following two-terminal carboxy group-containing Perfluoropolyether (P-6) (14.6 parts by mass), 20 parts by mass of thionyl chloride, and two droplets of N,N-dimethylformamide were mixed and refluxed under heating for 4 hours.

[Chemical Formula 21]

$$HOOC—CF_2O(CF_2CF_2O)_m(CF_2O)_nCF_2—COOH \quad \text{P-6}$$

In the above-mentioned structural formula, an average value of m is 8, and an average value of n is 5.

Subsequently, excess thionyl chloride was removed, whereby 15.0 parts by mass of the following Intermediate (P-7) was obtained.

[Chemical Formula 22]

$$ClOC—CF_2O(CF_2CF_2O)_m(CF_2O)_nCF_2—COCl \quad \text{P-7}$$

Subsequently, 4.0 parts by mass of glycerin diacrylate, 1.6 parts by mass of pyridine and 0.006 parts by mass of p-methoxyphenol were dissolved in 50 parts by mass of dichloroethane, and 15.0 parts by mass of Intermediate (P-7) was added. The mixture was stirred at room temperature (25° C.) overnight, and the dichloroethane was extracted by adding water. The organic layer was washed with water, and the solvent was distilled off to give 18.2 parts by mass of the following Perfluoropolyether (PFPE-F).

[Chemical Formula 23]

$$(XCH_2)_2CHO_2C—CF_2O(CF_2CF_2O)_m(CF_2O)_nCF_2—CO_2CH(CH_2X)_2 \quad \text{PEPE-F}$$

In the above-mentioned structural formula, an average value of m is 8, an average value of n is 5, and X is an acryloyloxy group.

<Synthesis of PFPE-G (Compound PFPE-12 (X=an Acryloyloxy Group))>

A cyclic trimer of hexamethylenediisocyanate (5.0 parts by mass), 0.01 part by mass of p-methoxyphenol, 0.01 part by mass of dibutyltin dilaurate, and 15 parts by mass of Vertrel XF (manufactured by Du Pont-Mitsui Fluorochemicals Co., Ltd.) were mixed, stirring was initiated under an air flow, and the temperature was raised to 50° C. Furthermore, 2.3 parts by mass of hydroxyethyl acrylate was added, and the mixture was stirred for 3 hours. Subsequently, a solution in which 20.3 parts by mass of the following Monoterminal hydroxy group-containing Perfluoropolyether (P-8) had been dissolved in 15 parts by mass of Vertrel XF was added dropwise, and a reaction was conducted by stirring the mixture at 50° C. for 6 hours.

[Chemical Formula 24]

$$CF_3CF_2CF_2CF_2O(CF_2CF_2CF_2O)_nCF_2CF_2—CH_2OH \quad \text{P-8}$$

In the above-mentioned structural formula, an average value of n is 10.

The disappearance of the absorption peak near 2,360 $cm^{-1}$ derived from an isocyanate group was confirmed by IR spectroscopy, and the solvent was distilled off, whereby 27.6 parts by mass of the following Perfluoropolyether (PFPE-G) was obtained.

[Chemical Formula 25]

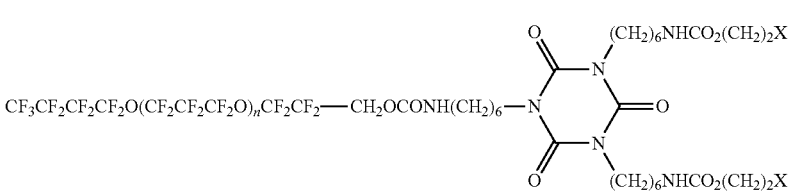

PFPE-G

In the above-mentioned structural formula, an average value of n is 10, and X is an acryloyloxy group.

<<Preparation of Surface-Modified Metal Oxide Particles>>

Surface-modified metal oxide particles 1 to 3 were prepared as follows.

<Preparation of Surface-Modified Metal Oxide Particles 1>

As metal oxide particles, 100 parts by mass of tin oxide having a number average primary particle size of 20 nm, 10 parts by mass of Exemplified Compound S-14 as a surface modifier, and 1,000 parts by mass of methyl ethyl ketone were put into a wet sand mill (alumina beads of 0.5 mm in diameter), the mixture was stirred at 30° C. for 6 hours, and the alumina beads were separated from the methyl ethyl ketone by filtration and dried at 60° C., whereby Surface-modified metal oxide particles 1 were prepared.

<Preparation of Surface-Modified Metal Oxide Particles 2>

As metal oxide particles, 100 parts by mass of copper-aluminum oxide having a number average primary particle size 50 nm, 5 parts by mass of Exemplified Compound S-14 as a surface modifier, and 1,000 parts by mass of methyl ethyl ketone were put into a wet sand mill (alumina beads of 0.5 mm in diameter), the mixture was stirred at 30° C. for 6 hours, and the alumina beads were separated from the methyl ethyl ketone by filtration and dried at 60° C., whereby Surface-modified metal oxide particles 2 were prepared.

<Preparation of Surface-Modified Metal Oxide Particles 3>

Surface-modified metal oxide particles 3 were prepared in a similar manner to that in the preparation of Surface-modified metal oxide particles 1, except that trimethoxypropylsilane was used as the surface modifier.

<<Preparation of Electrophotographic Photosensitive Body>>

Electrophotographic photosensitive bodies 1 to 20 were prepared as follows.

<Preparation of Electrophotographic Photosensitive Body 1>

(1) Preparation of Electroconductive Support

An electroconductive support was prepared by cutting a surface of a cylindrical aluminum support.

(2) Fomation of Intermediate Layer

A composition for an intermediate layer formed of the following composition was mixed, and dispersed by a batch system using a sand mill as a dispersing machine for 10 hours, whereby an application liquid for forming an intermediate layer was prepared.

Using the above-mentioned application liquid, the application liquid was applied onto an electroconductive support by an immersion application process so that the film thickness after drying at 110° C. for 20 minutes became 2 μm.

(Composition for Intermediate Layer)

Polyamide resin X1010 (manufactured by Daicel-Degussa Ltd.) 10 parts by mass

Titanium oxide SMT500SAS (manufactured by Tayca Corporation) 11 parts by mass

Ethanol 200 parts by mass (3) Formation of Charge Generating Layer

A composition for a charge generating layer formed of the following composition was mixed, and dispersed by a circulation ultrasonic homogenizer "RUS-600TCVP (manufactured by NISSEI Corporation)" at 19.5 kHz and 600 W and at a circulation flow amount of 40 L/h for 0.5 hours, whereby an application liquid for forming a charge generating layer was prepared.

This application liquid for forming a charge generating layer was applied onto an intermediate layer by an immersion application process to form a charge generating layer having a dry film thickness of 0.3 μm.

(Composition for Charge Generating Layer)

Charge generating substance (a mixed crystal of a 1:1 adduct of titanylphthalocyanine having clear peaks at 8.3°, 24.7°, 25.1° and 26.5° by Cu-Kα characteristic X-ray diffraction spectroscopy and (2R, 3R)-2,3-butanediol, and unadded titanylphthalocyanine) 24 parts by mass Polyvinylbutyral resin "S-LEC BL-1 (manufactured by Sekisui Chemical Co., Ltd.)" 12 parts by mass 3-Methyl-2-butanone/cyclohexanone=4/1 (V/V) 400 parts by mass (4) Formation of Charge Transporting Layer A composition for forming a charge transporting layer formed of the following composition was mixed and dissolved to prepare an application liquid for forming a charge transporting layer.

This application liquid for forming a charge transporting layer was applied onto a charge generating layer by an immersion application process, and dried at 120° C. for 70 minutes to form a charge transporting layer having a dry film thickness of 24 μm.

(Composition for Charge Transporting Layer)

The following Charge transporting substance ET-1 60 parts by mass

Polycarbonate resin "Z300 (manufactured by Mitsubishi Gas Chemical Company, Inc.)" 100 parts by mass Antioxidant "Irganox 1010 (manufactured by BASF Japan) 4 parts by mass

[Chemical Formula 26]

ET-1

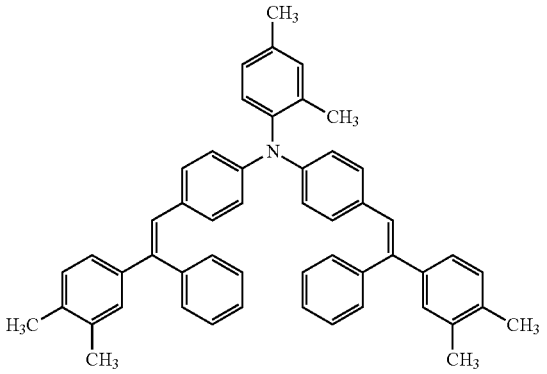

(5) Formation of Protective Layer

A composition for a protective layer having the following composition was dissolved and dispersed to prepare an application liquid for forming a protective layer. This application liquid was applied onto a charge transporting layer by using a circular slide hopper application machine. After the application, the application liquid was irradiated with ultraviolet ray for 1 minute with a metal halide lamp to form a protective layer having a dry film thickness of 3.0 μm, whereby Electrophotographic photosensitive body 1 was prepared.

(Composition for Protective Layer)

Radical-polymerizable monomer M6 90 parts by mass

Radical-polymerizable group PFPE (PFPE-A) 10 parts by mass

Surface-modified tin oxide particles (Surface-modified metal oxide particles 1) 45 parts by mass Dispersant ("Aron GF-300": manufacutured by Toagosei Co., Ltd.) 20 parts by mass Polymerization initiator ("Irgacure 819": manufactured by BASF Japan) 10 parts by mass 2-Butanol 250 parts by mass Ethylene glycol 50 parts by mass 2-Butanone 50 parts by mass <Preparation of Electrophotographic Photosensitive Bodies 2 to 20>

Electrophotographic photosensitive bodies 2 to 20 were prepared in a similar manner to that in the preparation of Electrophotographic photosensitive body 1, except that the radical-polymerizable monomer used for the formation of the protective layer, the kinds of the surface-modified metal oxide particles and the dispersant, and the addition amounts thereof were changed as described in Table I.

The average long diameter of the PFPE domain in the protective layer in each of Electrophotographic photosensitive bodies 1 to 20 was measured as follows.

Electrophotographic photosensitive bodies separately prepared at similar formulations were respectively prepared, and the protective layer was cut by a microtome in the thickness direction and the cross-sectional surface was enlarged to 10,000-fold under a scanning electron microscope (JEOL Ltd.), and the number average diameter of 20 domains that were randomly selected from an enlarged photograph of the cross-sectional surface was calculated as an average long diameter of the PFPE domain.

In Electrophotographic photosensitive bodies 19 and 20, any PFPE domain was not observed. The reason therefor is considered that, the addition amount of the radical-polymerizable PFPE was small in Electrophotographic photosensitive body 19, and the addition amount of the dispersant was too much in Electrophotographic photosensitive body 20.

<<Evaluation>>

Electrophotographic photosensitive bodies 1 to 20 prepared as above were sequentially mounted on a full-color copying machine (trade name: "bizhub PRO C6501", manufactured by Konica Minolta, Inc.), and variously evaluated. Specifically, a durability test in which letter images each having an image ratio of 15% are continuously printed on 500,000 sheets of A4 paper with horizontal feed under a high-temperature and high-humidity environment (HH environment) at 30° C./85% RH, and the wearing resistance, cleaning property and image blur of each electrophotographic photosensitive body were evaluated.

The evaluation results are shown in Table I.

<Evaluation of Wearing Resistance>

The depletion amounts of each electrophotographic photosensitive body before and after the above-mentioned durability test were measured and evaluated. The film thickness of the photosensitive body was measured as follows: the thicknesses on random ten parts on an even film thickness part (since the film thickness tends to be uneven at the both sides of the photosensitive body, the parts at at least 3 cm from the both sides are excluded), and the average value thereof is deemed as the film thickness of the photosensitive body. The film thickness meter was a film thickness meter of an eddy current system (trade name: "EDDY560C", manufactured by HELMUT FISCHER GMBTE CO), and the difference between the photosensitive body film thicknesses before and after a photographing test was deemed as a film thickness depletion amount. A film thickness depletion amount of 2.0 μm or less was evaluated to be acceptable.

<Evaluation of Cleaning Property>

During and after the above-mentioned durability test, the surface of the electrophotographic photosensitive body surface and the output images were visually observed, and evaluated according to the following evaluation criteria.

⊙: A perfectly acceptable level, no toner slip-through was observed up to 500,000 sheets.

○: A level with no problem in practical use, the output images were fine although toner slip-through was partially observed on the photosensitive body at the time point up to 500,000 sheets.

Δ: A level with no problem in practical use, although streak-like slight image defect occurred on any of output images before 500,000 sheets.

x: Streak-like slight image defect occurred due to toner slip-through on any of output images before 500,000 sheets (the electrophotographic photosensitive body had a problem in practical use)

<Evaluation of Image Blur>

The main power source of the actual machine was turned off immediately after the above-mentioned durability test, the power source was turned on at after 12 hours so that printing was enabled. A half tone image (relative reflection concentration measured by a Macbeth concentration meter: 0.4) was immediately printed on the whole surface of an paper sheet of A3 size, and a 6-dot lattice image was subsequently printed on the whole surface of a paper sheet of A3 size. The printing states of these images were visually observed, and evaluated according to the following evaluation criteria.

○: A perfectly acceptable level, any occurrence of image blur was not observed in both the half tone image and the 6-dot lattice image Δ: A level with no problem in practical use, although a thin band-like part with a decreased concentration was confirmed in the longitudinal direction of the photosensitive body in only the half tone image x: Defect due to image blur or thinning of line width was confirmed in the 6 dot lattice image (the electrophotographic photosensitive body had a problem in practical use)

TABLE 1

| | Radical polymerizable monomer | | Radical polymerizable PFPE | | Metal oxide particles | | Dispersant | |
|---|---|---|---|---|---|---|---|---|
| Electrophotographic photosensitive body No. | Kind | Addition amount [parts by mass] | Kind | Addition amount [parts by mass] | Kind | Addition amount [parts by mass] | Kind | Addition amount [parts by mass] |
| 1 | M6 | 90 | PFPE-A | 10 | Metal oxide particles 1 | 45 | GF300 | 20 |
| 2 | M6 | 70 | PFPE-A | 30 | Metal oxide particles 1 | 45 | GF300 | 10 |
| 3 | M6 | 70 | PFPE-A | 30 | Metal oxide particles 1 | 45 | GF300 | 20 |
| 4 | M2 | 80 | PFPE-B | 20 | Metal oxide particles 1 | 30 | — | — |
| 5 | M2 | 80 | PFPE-B | 20 | Metal oxide particles 1 | 80 | — | — |
| 6 | M2 | 80 | PFPE-B | 20 | Metal oxide particles 1 | 130 | — | — |
| 7 | M2 | 80 | PFPE-B | 20 | Metal oxide particles 1 | 160 | — | — |
| 8 | M2 | 90 | PFPE-B | 10 | Metal oxide particles 1 | 100 | — | — |
| 9 | M7 | 80 | PFPE-C | 20 | Metal oxide particles 1 | 100 | — | — |
| 10 | M6 | 80 | PFPE-D | 20 | Metal oxide particles 1 | 100 | GF300 | 10 |
| 11 | M10 | 80 | PFPE-D | 20 | Metal oxide particles 1 | 100 | GF300 | 10 |
| 12 | M2 | 80 | PFPE-E | 20 | Metal oxide particles 1 | 100 | — | — |
| 13 | M9 | 80 | PFPE-E | 20 | Metal oxide particles 1 | 100 | — | — |
| 14 | M2 | 70 | PFPE-F | 30 | Metal oxide particles 2 | 100 | — | — |

TABLE 1-continued

| | | | | | | | | |
|---|---|---|---|---|---|---|---|---|
| 15 | M6 | 80 | PFPE-F | 20 | Metal oxide particles 2 | 100 | — | — |
| 16 | M6 | 80 | PFPE-G | 20 | Metal oxide particles 2 | 100 | GF300 | 20 |
| 17 | M6 | 80 | PFPE-D | 20 | Metal oxide particles 2 | 100 | GF300 | 10 |
| 18 | M6 | 80 | PFPE-D | 20 | Metal oxide particles 3 | 100 | GF300 | 10 |
| 19 | M2 | 95 | PFPE-B | 5 | Metal oxide particles 1 | 100 | — | — |
| 20 | M10 | 80 | PFPE-D | 20 | Metal oxide particles 1 | 80 | GF300 | 50 |

| Electrophotographic photosensitive body No. | Domain average longitudinal diameter [μml | Depletion amount [μml | Cleaning property | Image blur | Remarks |
|---|---|---|---|---|---|
| 1 | 0.04 | 1.4 | Δ | Δ | Present invention |
| 2 | 0.17 | 0.7 | ⊙ | ○ | Present invention |
| 3 | 0.11 | 1.5 | ○ | ○ | Present invention |
| 4 | 0.37 | 1.9 | ○ | ○ | Present invention |
| 5 | 0.23 | 1.3 | ⊙ | ○ | Present invention |
| 6 | 0.14 | 1.1 | ⊙ | ○ | Present invention |
| 7 | 0.09 | 0.7 | ○ | Δ | Present invention |
| 8 | 0.10 | 0.8 | ○ | ○ | Present invention |
| 9 | 0.25 | 1.2 | ⊙ | ○ | Present invention |
| 10 | 0.33 | 0.9 | ⊙ | ○ | Present invention |
| 11 | 0.21 | 1.1 | ⊙ | ○ | Present invention |
| 12 | 0.06 | 1.2 | ○ | Δ | Present invention |
| 13 | 0.35 | 1.4 | ○ | ○ | Present invention |
| 14 | 1.12 | 1.7 | ⊙ | ○ | Present invention |
| 15 | 0.73 | 0.9 | ⊙ | ○ | Present invention |
| 16 | 1.22 | 1.8 | ○ | ○ | Present invention |
| 17 | 0.19 | 1.4 | ⊙ | ○ | Present invention |
| 18 | 0.45 | 1.6 | ○ | ○ | Present invention |
| 19 | Not observed | 0.4 | Δ | X | Comparative Example |
| 20 | Not observed | 2.5 | Δ | X | Comparative Example |

CONCLUSION

As is apparent from Table I, it was confirmed that the electrophotographic photosensitive bodies of the present invention were more excellent than the electrophotographic photosensitive bodies of Comparative Examples in the evaluations of the wearing resistance, cleaning property and image blur.

Accordingly, it is understood that it is useful that the protective layer has a domain containing a perfluoropolyether in providing an electrophotographic photosensitive body having high wearing resistance, having sustained high cleaning property, and providing suppressed image blur under a high-temperature and high-humidity environment, and an image forming apparatus including this electrophotographic photosensitive body.

According to an embodiment of the present invention, the mechanisms of expression and action of the effect of the present invention has not been clarified, but are conjectured as follows.

The mechanism of image blur in the surface layer containing a perfluoropolyether (PFPE) is presumed as follows.

During charging of the electrophotographic photosensitive body, the ether bond moieties in the PFPE are cleaved by discharging products such as ozone and nitrogen oxides, and hydroxyl groups are generated. It is considered that, since the hydroxy groups generated by the cleaving of the PFPE chain have high acidity, the surface resistance is lowered under a high-temperature and high-humidity environment, and thus image blur easily occurs.

Meanwhile, it is considered that, if the PFPE is flocculated and forms a domain in the surface layer (protective layer), the surface layer (protective layer) is hard to undergo the above-mentioned chemical deterioration as compared to a case where the PFPE is evenly distributed in a molecule-dispersed state in the surface layer. It is presumed that, as a result thereof, image blur under a high temperature and a high humidity can be suppressed.

On the other hand, the PFPE has a flexible structure since the degree of freedom of rotation of the ether moieties is high, and thus has high molecular mobility. Therefore, it is considered that, even if an outermost layer is lost due to mechanical stress such as cleaning or chemical deterioration, the PFPE that is present inside of the surface layer transfers to the surface of the layer and is oriented again, and thus high cleaning property is sustained.

However, if the chemical deterioration of the PFPE progress fast, the cleaved PFPE is easily removed due to mechanical stress by a cleaning blade or the like, and thus it is presumed that the PFPE that is present inside of the surface layer cannot transfer to the surface from the inside of the surface layer at a velocity sufficient for maintaining high cleaning property.

Therefore, it is presumed that high cleaning property can be maintained for a longer period by forming a domain by allowing PFPE to flocculate so that the surface layer becomes difficult to undergo chemical deterioration.

Although embodiments of the present invention have been described and illustrated in detail, the disclosed embodiments are made for purposes of illustration and example only and not limitation. The scope of the present invention should be interpreted by terms of the appended claims.

What is claimed is:

1. An electrophotographic photosensitive body comprising:

at least a photosensitive layer and a protective layer sequentially laminated on an electroconductive support, wherein the protective layer comprises a matrix containing a binder resin and a domain containing perfluoropolyether.

2. The electrophotographic photosensitive body according to claim 1, wherein the domain has an average long diameter in the range of 0.05 to 1.00 μm.

3. The electrophotographic photosensitive body according to claim 1, wherein the protective layer is formed by radically polymerizing a radical-polymerizable composition containing a radical-polymerizable monomer and a perfluoropolyether having radical-polymerizable group(s).

4. The electrophotographic photosensitive body according to claim 3, wherein the radical-polymerizable composition further contains metal oxide particles.

5. The electrophotographic photosensitive body according to claim 4, wherein the content of the metal oxide particles in the radical-polymerizable composition is in the range of 45 to 150 parts by mass with respect to the total amount (100 parts by mass) of the polymerizable monomer and the perfluoropolyether having radical-polymerizable group(s).

6. The electrophotographic photosensitive body according to claim 4, wherein the metal oxide particle is a metal oxide particle having a radical-polymerizable group.

7. The electrophotographic photosensitive body according to claim 3, wherein the perfluoropolyether having radical-polymerizable group(s) is a perfluoropolyether having a structure represented by the following General Formula (1):

$$(X)_q\text{-A-}CF_2O(CF_2CF_2O)_m(CF_2O)_nCF_2\text{-A-}(X)_q \quad \text{General Formula (1)}$$

wherein in General Formula (1), A represents a linking group having a valency of (q+1), X represents a radical-polymerizable group, m and n each represents an integer of 0 or more, provided that m+n≥5, and q represents an integer of 1 or more.

8. The electrophotographic photosensitive body according to claim 7, wherein the radical-polymerizable group represented by X in General Formula (1) is an organic group having a structure represented by the following General Formula (2):

General Formula (2)

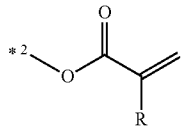

wherein in General Formula (2), R represents a hydrogen atom or a methyl group, and *2 represents a binding site to the linking group A.

9. The electrophotographic photosensitive body according to claim 3, wherein the radical-polymerizable monomer contains a carbon-carbon double bond.

10. The electrophotographic photosensitive body according to claim 3, wherein the radical-polymerizable monomer is selected from the group consisting of styrene monomers, acryl monomers, methacryl monomers, vinyl toluene monomers, vinyl acetate monomers and N-vinylpyrrolidone monomers.

11. An image forming apparatus comprising the electrophotographic photosensitive body according to claim 1.

* * * * *